US011927185B2

(12) United States Patent
Westendarp et al.

(10) Patent No.: US 11,927,185 B2
(45) Date of Patent: Mar. 12, 2024

(54) LOBE PUMP

(71) Applicant: BMA BRAUNSCHWEIGISCHE MASCHINENBAUANSTALT AG, Braunschweig (DE)

(72) Inventors: Hans-Heinrich Westendarp, Braunschweig (DE); Folker Aljets, Salzgitter (DE)

(73) Assignee: BMA BRAUNSCHWEIGISCHE MASCHINBAUANSTALT AG, Braunschweig (DE)

( * ) Notice: Subject to any disclaimer, the term of this patent is extended or adjusted under 35 U.S.C. 154(b) by 835 days.

(21) Appl. No.: 16/970,025

(22) PCT Filed: Feb. 14, 2019

(86) PCT No.: PCT/EP2019/053640
§ 371 (c)(1),
(2) Date: Aug. 14, 2020

(87) PCT Pub. No.: WO2019/158631
PCT Pub. Date: Aug. 22, 2019

(65) Prior Publication Data

US 2021/0363988 A1 Nov. 25, 2021

(30) Foreign Application Priority Data

Feb. 15, 2018 (DE) ..... 10 2018 103 460.1

(51) Int. Cl.
*F04C 15/00* (2006.01)

(52) U.S. Cl.
CPC ..... *F04C 15/0007* (2013.01); *F04C 2240/20* (2013.01); *F04C 2250/20* (2013.01)

(58) Field of Classification Search
CPC .. F04C 2/3445; F04C 2/3443; F04C 15/0007; F04C 2240/20; F04C 2250/20; F04C 15/0019
See application file for complete search history.

(56) References Cited

U.S. PATENT DOCUMENTS 676,687 A * 6/1901 Piatt ..... F04C 2/3445 418/250
9,638,204 B2 * 5/2017 Hayes-Pankhurst .... F01C 19/04
(Continued)

FOREIGN PATENT DOCUMENTS

AT 189063 B 2/1957
CN 2411360 Y 12/2000
(Continued)

*Primary Examiner* — Bryan M Lettman
(74) *Attorney, Agent, or Firm* — WCF IP

(57) ABSTRACT

A lobe pump is provided. The lobe pump may include a housing having an inlet and an outlet for a medium to be pumped, at least one lobe mounted in the housing so as to be drivable and rotatable and which has at least two conveying vanes, and at least one sealing element per lobe mounted on a sealing body. The at least one sealing element runs over a contour of the at least one lobe during rotation of the at least one lobe and performs an outward travel movement from a minimum diameter of the at least one lobe to a maximum diameter of the at least one lobe and an inward travel movement from the maximum diameter of the at least one lobe to the minimum diameter of the at least one lobe on different sides of each of the at least two conveying vanes.

16 Claims, 7 Drawing Sheets

(56) References Cited

U.S. PATENT DOCUMENTS

Figure 1:
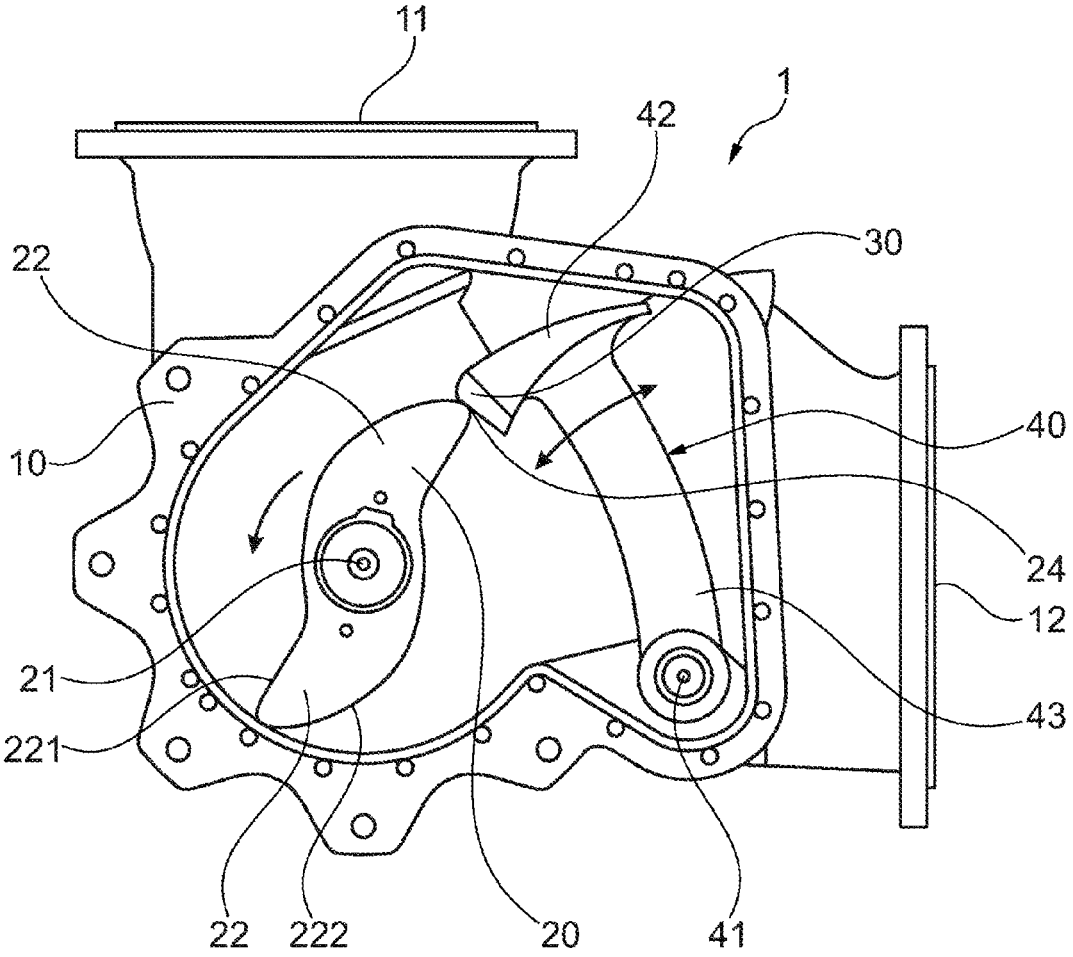

| | | | | |
|---|---|---|---|---|
| 10,495,085 | B2 * | 12/2019 | Hayes-Pankhurst | F04C 15/0015 |
| 2005/0254968 | A1 * | 11/2005 | Patterson | F04C 2/3566<br>417/410.3 |
| 2013/0142685 | A1 * | 6/2013 | Moeller | F01C 1/123<br>418/191 |
| 2016/0010643 | A1 * | 1/2016 | Hayes-Pankhurst | F01C 1/3566<br>418/139 |

FOREIGN PATENT DOCUMENTS

| | | | | |
|---|---|---|---|---|
| DE | 125174 | C | | 11/1901 |
| DE | 850721 | C | | 9/1952 |
| DE | 1709909 | U | | 11/1955 |
| DE | 960411 | C | | 3/1957 |
| DE | 1 553 140 | A1 | | 7/1964 |
| DE | 6753460 | | * | 4/1969 |
| DE | 6753460 | U | | 4/1969 |
| DE | 6927594 | U | | 8/1971 |
| DE | 78 11 068 | U1 | | 2/1979 |
| DE | 7 251 | C | | 3/1979 |
| FR | 626596 | A | | 9/1927 |
| GB | 746338 | | * | 3/1956 |
| GB | 746338 | A | | 3/1956 |
| GB | 151338 | | * | 5/1969 |
| GB | 1151338 | A | | 5/1969 |
| NL | 25897 | C | | 7/1931 |

* cited by examiner

LOBE PUMP

The invention relates to a lobe pump with a housing, having an inlet and an outlet for the medium to be pumped, at least one lobe, which is mounted in the housing so as to be drivable and rotatable and which has at least two conveying vanes provided with a contour, which convey the medium to be delivered from the inlet to the outlet, and one sealing element per lobe, which is fastened to an in particular swivelably mounted sealing body and runs over the contour of the lobe during rotation of the at least one lobe and performs an outward travel movement from a minimum diameter of the at least one lobe to a maximum diameter of the at least one lobe and an inward travel movement from the maximum diameter of the at least one lobe to the minimum diameter of the at least one lobe. Such a lobe pump is suitable and intended in particular for pumping highly viscous media, for example magma in sugar production. Magma is a mixture of sugar crystals and syrup and arises as a sugar production intermediate during the boiling process. Such a lobe pump is not limited to pumping magma, however, although it is particularly suitable for pumping crystal suspensions.

DE 67 53 460 U1 discloses a lobe pump with a mirror-symmetrical lobe, over the outer contour of which runs a sealing element. The lobe has a substantially elliptical contour. The sealing element is fastened to a swivel lever.

DE 78 11 068 U1 provides a lobe pump with a housing, an inlet at the bottom within the housing and an outlet arranged thereabove. A spring-loaded slide, by means of which a sealing element is urged against the lobe, is arranged between inlet and outlet. The lobe takes the form of a rounded lozenge which is mirror-symmetrical relative to the short axis and the longitudinal axis.

DE-N 7251 relates to a lobe pump for conveying viscous substances, in which a positively controlled abutment slide follows the outline shape of the lobe. Positive control is achieved using control cams, which bring about a movement of a cylindrical sealing part which follows the contour of the conveying lobe. The lobe has a cross-sectional shape curved in an S shape.

Disadvantages of such lobe pumps include a comparatively low pump volume per revolution and heavy wear of the lobe and the sealing element in the case of non-positively driven sealing elements. The lobe contour in this case leads to urging away of the sealing element from the piston and thus to leaks and delivery losses. To prevent this, an elevated contact pressure has to be applied, which leads to an elevated energy requirement and elevated wear.

The object of the present invention is to provide a lobe pump which exhibits an enlarged pump volume per revolution, such that, while retaining the same pump volume, the lobe pump can be of smaller, less expensive construction.

This object is achieved by a lobe pump having the features of the main claim. Advantageous embodiments and further developments of the invention are disclosed in the subclaims, the description and the figures.

The lobe pump with a housing, having an inlet and an outlet for the medium to be pumped, with at least one lobe, which is mounted in the housing so as to be drivable and rotatable and which has at least two conveying vanes provided with a contour, which convey the medium to be delivered from the inlet to the outlet, and with one sealing element per lobe, which is mounted or formed on a sealing body and runs over the contour of the lobe during rotation of the lobe and performs an outward travel movement from a minimum diameter of the lobe to a maximum diameter of the lobe and an inward travel movement from the maximum diameter of the lobe to the minimum diameter of the lobe on different sides of the conveying vane, provides that the distance which the sealing element covers on the inward travel side of the conveying vane during the inward travel movement is shorter or smaller than the distance on the outward travel side during the outward travel movement. The outward travel movement starts when, from a minimum diameter of the lobe, the sealing element moves away from the axis of rotation of the lobe, and the inward travel movement starts when, from the maximum lobe radius, the sealing element moves during rotation of the lobe towards the minimum diameter of the lobe. The end of the inward travel movement is reached when the point of contact or the line of contact between the contour of the lobe and the sealing element has reached the minimum diameter of the lobe, and the outward travel movement ends when the maximum lobe radius has been reached by the point of contact or line of contact. There is a possibility for the contour of the lobe to be embodied such that the diameter remains constant over a given angular range, in particular assumes the minimum diameter and/or maximum diameter of the lobe, such that the overall angle over which an inward travel movement and an outward travel movement is performed amounts to less than 180°, if the lobe is embodied as a lobe with two conveying vanes. The inward travel speed of the sealing element and the outward travel speed are determined, in the case of a constant rotational speed, by the contour of the respective conveying vane of the lobe. If it is possible for the sealing element to move very rapidly towards a minimum lobe radius or towards the axis of rotation of the lobe, a high inward travel speed is present, which is achieved by the contour falling away steeply over the angle of rotation. Conversely, the sealing element moves slowly radially outwards on the contour of the lobe if only a small gradient is present over an angle of rotation. In particular when pumping thick, highly viscous media, it is problematic to urge the locking element, which is mounted or formed on a sealing body, outwards within the medium, i.e. from the minimum diameter of the lobe to the maximum diameter of the lobe. The sealing element and the sealing body have also to be moved through the highly viscous medium during the inward travel movement. These movements have in general to be applied against the resistance of the sealing body mounted in the medium to be conveyed. The conveying vane itself, along which the sealing body slides with the sealing element, cannot be of any desired thinness, since on the one hand strength conditions have to be met and on the other hand acceleration limit values have to be complied with, for example in order to avoid the sealing element lifting away from the surface of the lobe. It has proved advantageous to allow the sealing element to undertake an outward travel movement comparatively slowly. In the region of the maximum lobe radius, a rounded area is generally formed, in order to avoid an abrupt reversal of movement of the sealing element running over the rotating lobe. Provision is made, in particular, for the conveying vane to be narrower and steeper on the inward travel side than on the outward travel side. As a result of the reduced conveying vane volume on the inward travel side relative to the outward travel side, the chamber volume, which is formed by the housing and the conveying vane contour, is enlarged compared to a mirror-symmetrical contour on both sides of the connecting line of the in each case maximum lobe radius through the axis of rotation, and excessively heavy loads on the material caused by excessively high acceleration during the outward travel movement are simultaneously prevented. The lower outward travel speed compared with the inward travel speed preferably occurs in an embodiment of the lobe with two conveying vanes over an angle of rotation of at least greater than 90° up to an angle of rotation of up to 160°, in particular in a range from 110° to 130°, whereby rapid inward travel of the sealing element and thereby enlargement of the pump chamber may be achieved.

In one further development of the invention, the contour on the outward travel side of the lobe may have a curvature without inflection points in the gradient of the contour, while the contour on the inward travel side preferably has at least one inflection point, whereby it is defined that on the inward travel side a maximum reduction in the volume of the conveying vane takes place and after a phase with a very high inward travel speed, i.e. a very steep contour of the conveying vane on the inward travel side, this is flattened off, so as to provide a gentle transition until the minimum diameter of the lobe is reached.

In one variant of the invention provision is made for the minimum lobe radius on the inward travel side to be reached by the sealing element at an angle of rotation of between 30° and 90°, measured from the maximum lobe radius. In this way, it is ensured that the minimum lobe radius is reached very rapidly. On the outward travel side, the outward travel movement may begin between 90° and 150° before the maximum lobe radius is reached, wherein the contour on the outward travel side preferably has a curvature without inflection point or discontinuities, so as to achieve a uniform, comparatively slow outward travel movement of the sealing element and thus of the sealing body. As a result of the outward travel side being more solid and provided with more material in comparison with the inward travel side, it remains additionally possible to apply high forces and torques, which must be applied by the pump to convey the viscous product.

The maximum lobe radius may be reached by the sealing element, after the minimum lobe radius on the outward travel side has been left, at an angle of rotation of between 90° and 150°, such that with a corresponding configuration on the inward travel side and with comparatively early reaching of the contour at the minimum lobe radius, the volume of the conveying vane has to be configured to be smaller on the inward travel side than on the outward travel side.

Particularly preferably, the lobe has two conveying vanes, the contours of which are point-symmetrical to the axis of rotation of the lobe. The two-vaned embodiment provides a large chamber volume.

In one further development of the invention, provision is made for the sealing body to be mounted swivelably within the housing on a swivel arm. It is thus possible to achieve robust mounting with a comparatively compact construction and without complex spring and/or bearing mechanisms. It is in principle also possible to arrange the sealing element on a linear-mounted, spring-loaded sealing body. As a result of the position of the bearing point of the swivelable mounting in the housing, it is possible to utilize the pressure present within the pump housing, in particular the pressure difference between the inlet and the outlet, by exerting a force on the sealing element which presses the sealing element more forcibly against the lobe contour in the event of a higher pressure difference and thus reduces losses and increases operational reliability. The width of the sealing element is likewise a factor which, together with the pressure difference, influences the contact pressure against the contour of the conveying vane.

The distance between the bearing point of the swivelably mounted swivel arm and the point of contact of the sealing element against the conveying vane is preferably large compared to the lobe radius. An approximately linear movement of the sealing element in the outward travel direction or inward travel direction is desirable. This is achieved in that the swivel arm is selected to be as long as possible. The distance between the bearing point of the swivel arm and the point of contact of the sealing element with the conveying vane preferably amounts to 1.5 times to 2 times the radius of the lobe. The length of the swivel arm is here in competition with maximally compact housing dimensions. The longer the swivel arm which has to be mounted in the housing, the larger must the housing be. Therefore, a radius of 1.5 to 2 times the radius of the lobe, preferably 1.65 to 1.85 times the radius has proven to be a good compromise for achieving a maximally linear inward and outward travel movement of the sealing element.

The swivel arm is preferably mounted on the outlet side in the housing, in order not to reduce pump volume per revolution and to press the sealing element against the conveying vane by means of the differential pressure between inlet and outlet. To reduce flow resistance, the swivel arm is rounded or has an oval cross-section, in order to ensure a flow-optimized arrangement of the swivel arm within the pumped medium.

In one further development of the invention, the sealing element has a wide, optionally planar contact surface and at least one rounded contact portion adjacent thereto. The contact portion or contact portions may form the two ends of the sealing element. The width of the contact surface makes it possible to form a plurality of lines of action between the sealing element and the contour of the lobe, in particular also to allow the point of contact or the line of contact of the sealing element on the contact surface to advance with the sealing body, in order to reduce wear. Advance of the line of action along the contact surface is obtained as a result of the different gradients over the contour of the conveying vanes. As a result of the rounded contact portions at the front or rear end of the sealing element, reliable contact may be achieved even with varying curvatures. The line of action advantageously has a larger radius on the inward travel side than on the outward travel side. The point of contact or the line of contact thus advances outward on the sealing element when the sealing element travels inward, and then back to the middle of the sealing element. The point of contact or the line of contact advances inward on the sealing element or towards the point of rotation of the swivel arm when the sealing element travels outward and then back to the middle of the sealing element. The shape of the sealing element and association thereof with the contour of the lobe may be configured such that, with a minimum lobe radius and a maximum lobe radius, the point of contact or the line of contact of the sealing element lies roughly in the middle thereof.

The sealing element may have a planar contact surface and at least one rounded contact portion adjacent thereto, wherein at least one of the rounded contact portions extends over a circular arc with a central angle of greater than or equal to 90°, such that a scraping surface is adjacent thereto. The angle between the scraping surface and the contact surface is thus less than or equal to 90°.

In one further development of the invention, provision is made for the angle between the straight line through the point of rotation of the swivel arm and the point of contact or line of contact of the sealing element and a planar contact surface of the sealing element in the maximum lobe radius position amounts to between 5° and 25°, preferably between 10° and 20°, particularly preferably between 12° and 18°, so as to have just one point of contact in the cross-section or one line of contact and thus a single sealing line on contact of the sealing element with the contour of the conveying vane or of the lobe. On the other hand, pinching or leaks would arise if line contact was not single but rather double.

The contours of the lobe and of the sealing element may be matched with one another in such a way that, at the point of contact between the lobe and the sealing element, the angle between the perpendicular to the lobe surface and the tangent to the direction of movement of the sealing element amounts to between 0° and 70°, with particular constructions to between 0° and 50°, on inward travel and between 0° and at most 45° on outward travel, whereby, on urging out, the sealing body is moved with low friction losses and for inward travel gentle sliding is enabled. On inward travel, large angles point to rapid inward travel, while on outward travel, the smallest possible value is desirable, in order to reduce friction.

If the line of action of the sealing element, which is defined as the radius about the point of rotation of the locking vane through the point of contact of lobe and sealing element, on the outward travel side is different from the line of action on the inward travel side, it is possible to provide a comparatively large sealing element with a comparatively large width, since, due to the different radii of the lines of action, the friction point or the sealing line between the sealing element and the surface of the lobe has to advance over the sealing element. The radius of the line of action is preferably smaller on the outward travel side than on the inward travel side. The possibility of enlarging the width results in reduced wear, since the total available sealing surface which is loaded abrasively is enlarged.

As a result of the comparatively long swivel arm, it is possible for the sealing element to perform a maximally linear swivel path during the outward travel movement and the inward travel movement. Thanks to a reduction in the distance from the maximum lobe radius to the minimum lobe radius and the non-mirror-symmetrical embodiment of the lobe contour to a connecting line connecting two maximum, mutually opposing lobe radii through the axis of rotation, the path which the sealing element has to travel on the lobe is minimized. The sealing element has likewise to travel a shorter path in the medium to be pumped. As a result of an outward travel movement which is slowed down in comparison with the inward travel movement, the speeds and accelerations of the sealing body and of the swivel arm in the medium are kept as small as possible on the pressure side, which brings about a further energy saving during operation of the lobe pump. An energy saving is achieved in particular on outward travel when the angle at the point of contact of the sealing element is selected such that the sealing element is urged out in maximally perpendicular manner, such that the lowest possible friction losses occur.

Figure 2:
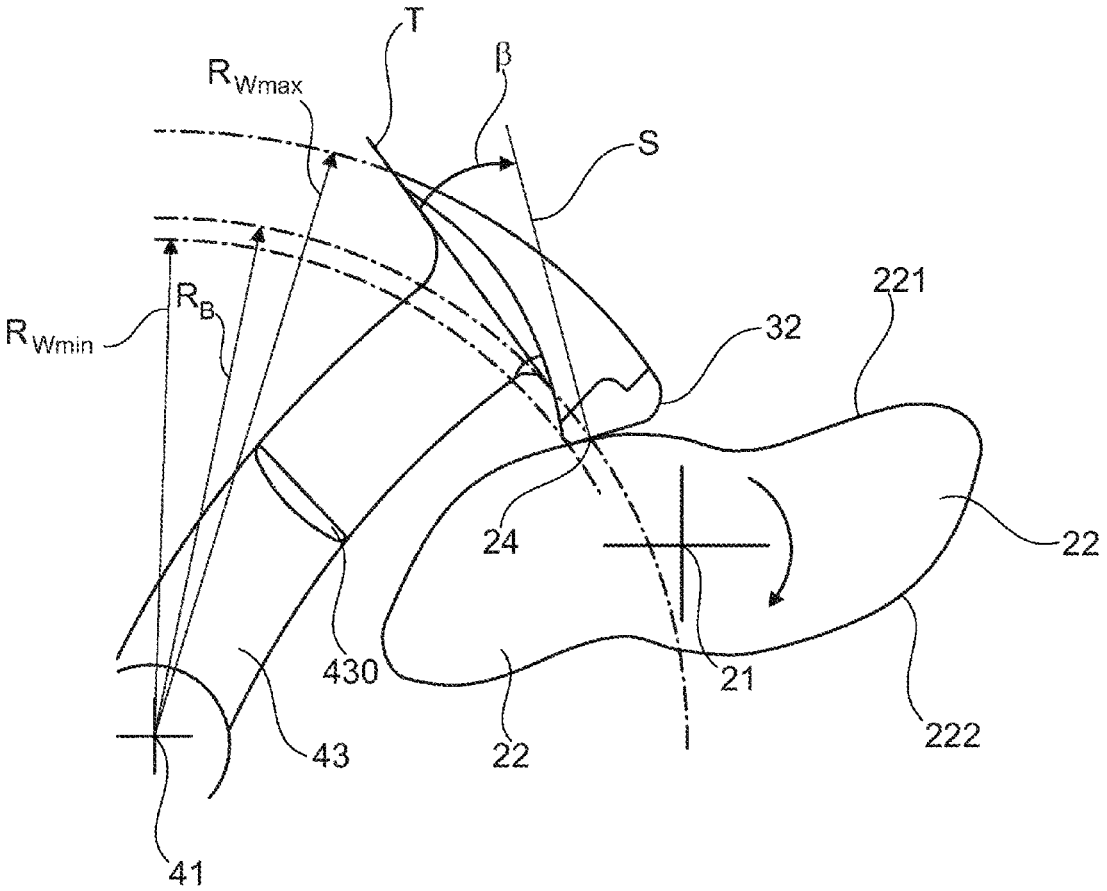
Figure 3:
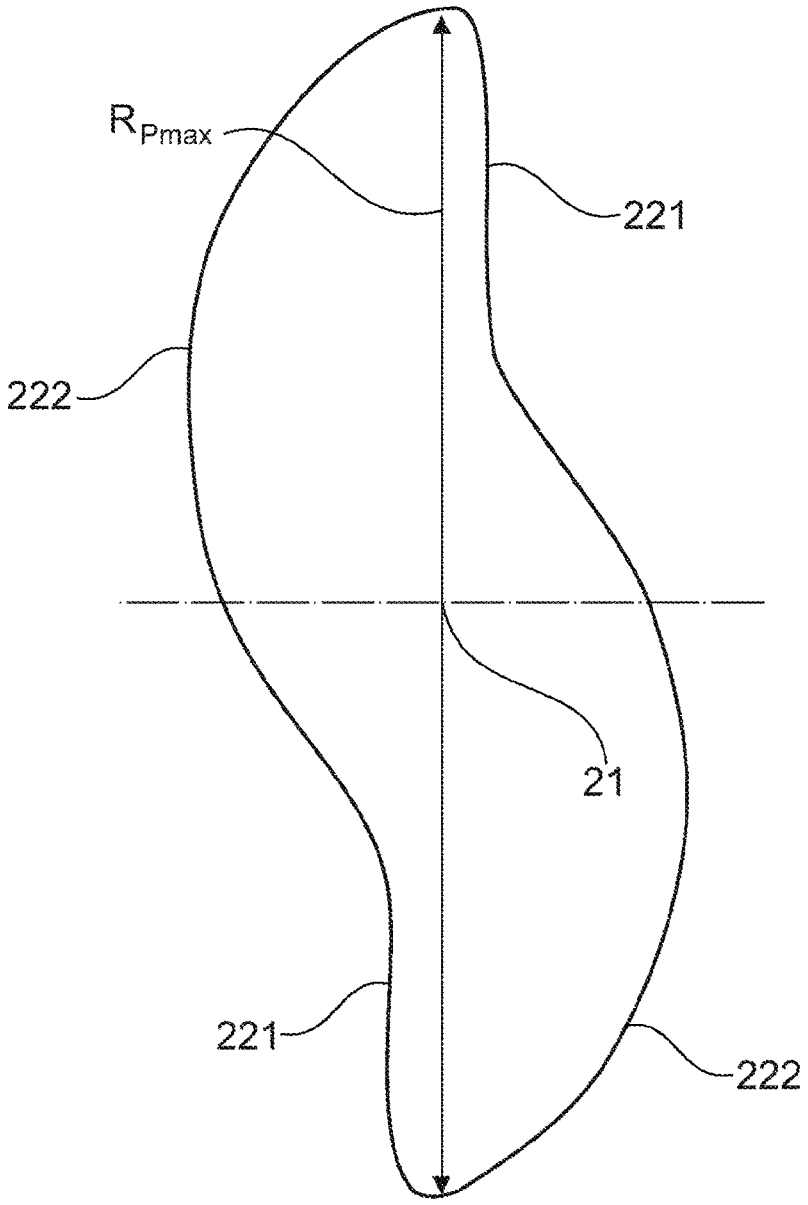
Figure 4:
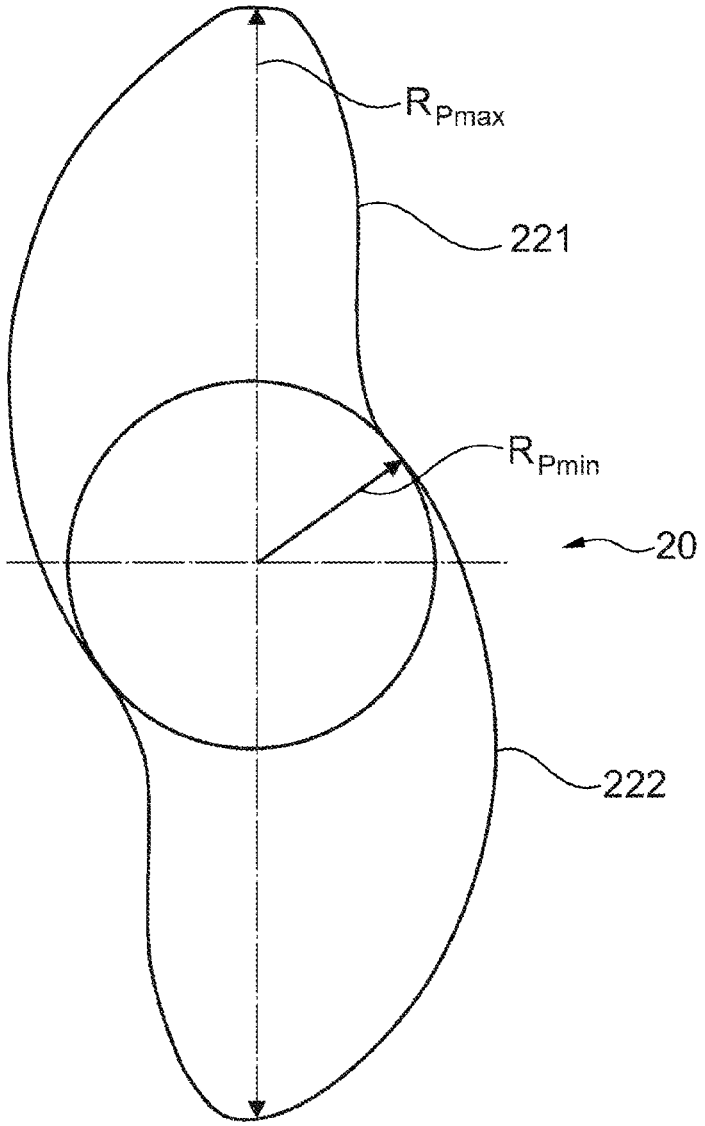
Figure 5:
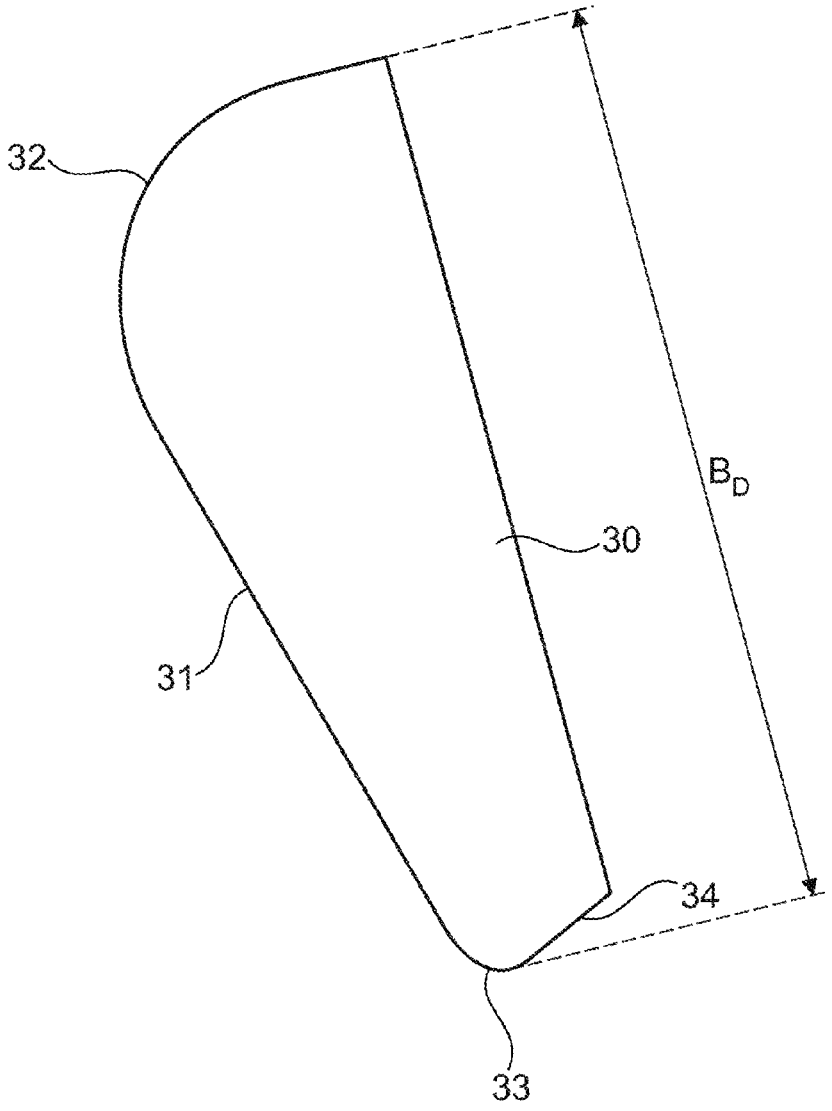
Figure 6:
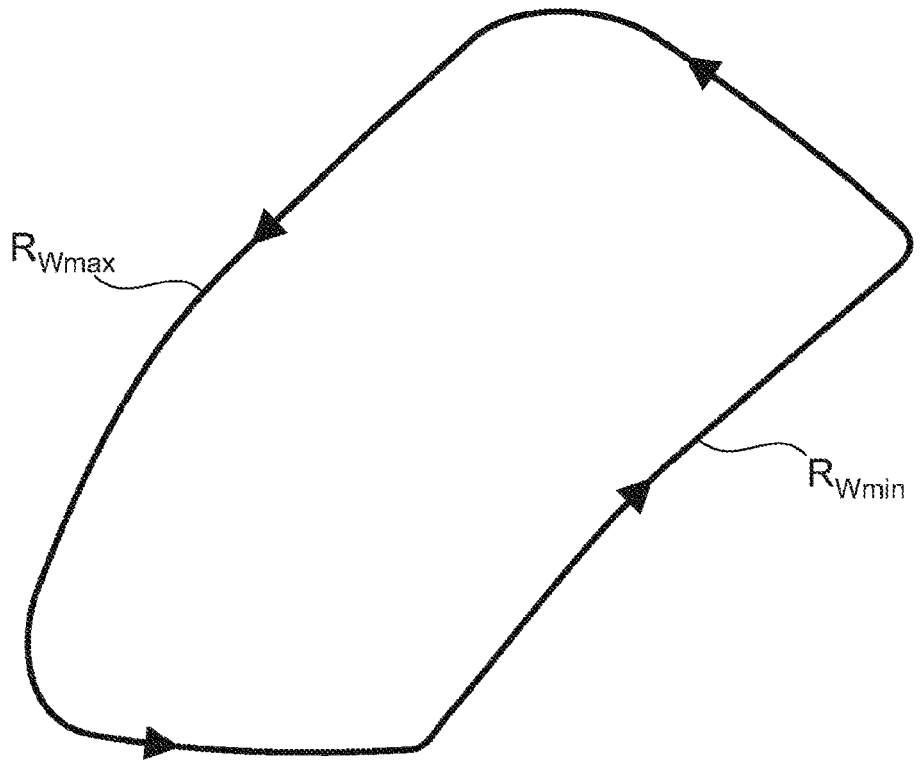
Figure 7:
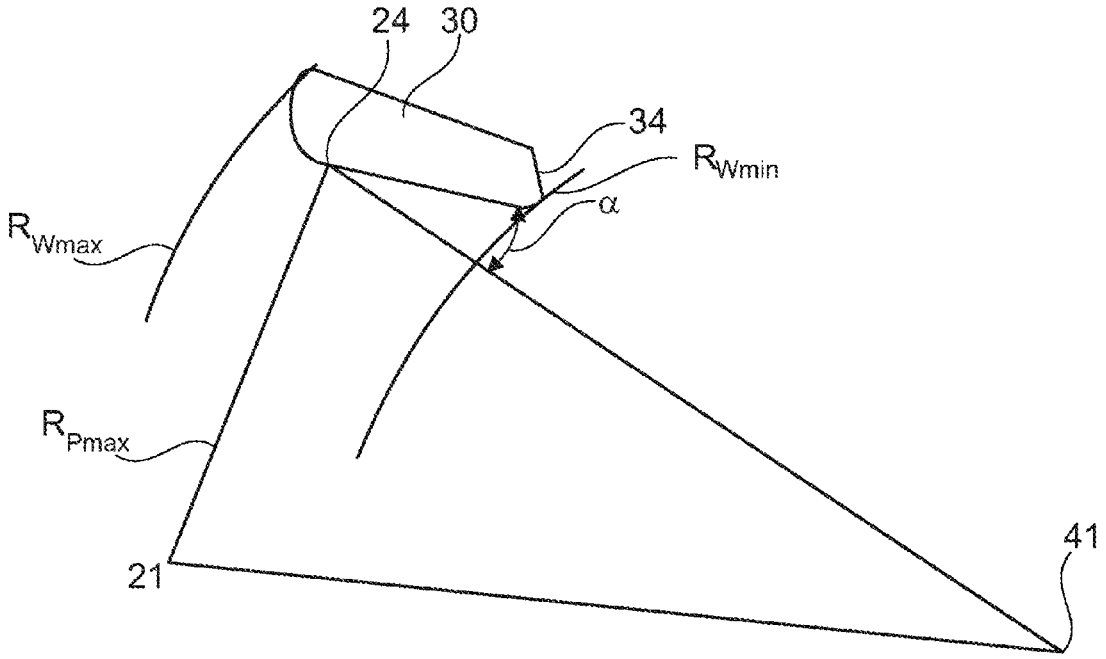

Exemplary embodiments of the invention are explained in greater detail below with reference to the attached figures, in which:

FIG. 1—is a sectional representation of a pump in overall view;

FIG. 2—is a representation of a detail of a lobe with sealing element but without housing;

FIG. 3—is a sectional representation through a lobe contour;

FIG. 4—shows a lobe contour according to FIG. 3 with labeled regions;

FIG. 5—is a partial representation of a sealing element;

FIG. 6—is an exemplary representation of the sequence of the points of contact over a half-rotation of a lobe with two conveying vanes and clarification of the lines of action; and FIG. 7—is a schematic diagram of the interaction of sealing element and lobe.

FIG. 1 is a schematic sectional representation of a lobe pump 1 with a housing 10, which has an inlet 11 at the top and an outlet 12 oriented substantially perpendicularly to the inlet 11 and arranged, in FIG. 1, on the right-hand side. A lobe 20 is mounted inside the housing 10 so as to be rotatable about an axis of rotation 21. By means of the lobe 20, which has two conveying vanes 22 on mutually opposing sides, the in particular viscous medium, in particular magma in sugar production, is conveyed from the inlet 11 to the outlet 12. The direction of rotation of the lobe 20 is in this case anticlockwise, as indicated by the arrow. The lobe 20 with the two conveying vanes 22 runs in part over a cylindrical housing wall and, together with a sealing element 30, which runs over the outer contour of the lobe 20 during rotation thereof, and a sealing body 42 of a locking vane 40, forms the separator between the inlet side and the outlet side.

The sealing element 30 is mounted or formed on the sealing body 42 of the locking vane 40, which is in turn mounted in a bearing mounting 41 by means of a swivel arm 43. The locking vane 40 is mounted within the housing 10 on the outlet side so as to be swivelable about a swivel axis and moves as a function of the position of the lobe 20 towards the axis of rotation 21 of the lobe or away from the axis of rotation 21 towards a maximum lobe radius.

In sectional representation the sealing element 30 lies against a point of contact 24, in three-dimensional configuration along a line of contact 24 against the contour of the lobe 20. In the depicted position according to FIG. 1, the sealing element 30 lies against the maximum lobe radius and is thus swiveled maximally clockwise about the bearing point 41 or the swivel axis through the bearing point 41. When the lobe 20 is rotated anticlockwise to convey the medium to be pumped, the sealing element slides on the surface of the lobe 20 towards the swivel axis 21 and thus travels from a maximum lobe radius towards a minimum lobe radius along an inward travel side 221. Once a minimum lobe radius is reached, the sealing element 30 slides along the contour of the lobe and is urged back outwards in the clockwise direction towards the position depicted in FIG. 1, optionally against a spring force which urges the sealing element 30 together with the sealing body 42 of the locking vane 40 towards the lobe 20. The sealing element 30 thus performs an outward movement or outward travel movement when the sealing element 30 slides along the outward travel side 222.

The swivel arm 43 may be loaded with a corresponding spring force in the region of the bearing point 41 or swivel axis through the bearing point 41, which spring force brings about pretensioning against movement in the clockwise direction. The sealing body 42 and in particular the sealing surface of the locking vane 40 extends over the entire depth of the housing, such that the lobe 20, together with the sealing element 30 and the sealing body 42, always brings about effective separation between the inlet side and the outlet side.

FIG. 2 shows a detail representation of lobe and sealing means according to FIG. 1 in a mirror-inverted representation. The direction of rotation of the lobe 20 is indicated by the arrow. In addition to the axis of rotation 21, the lobe 20 has two conveying vanes 22, which are formed point-symmetrically relative to the center point, which is defined by the point of rotation 21 or by the axis of rotation 21. The sealing element 30 has slid along the inward travel side 21 on the outer contour of the first conveying vane 22, wherein, due to the contour of the lobe 20 and the contour of the sealing element 30, there was always linear contact between the sealing element 30 and the lobe 20. The point of contact 24 in FIG. 2 or line of contact 24 advances along the surface of the sealing element 30 as the lobe 20 rotates. The radius RF of the distance of the contact point 24 from the bearing point 41 or the line of contact 24 from the axis of rotation of the swivel arm 43 through the bearing point 41 thus varies during movement of the lobe 20. To minimize friction losses, the orientation of the surface of the sealing element 30 to the contour of the lobe 20 is selected such that, on the outward travel side 222, the angle β between the perpendicular S to the lobe surface and the tangent T to the direction of movement of the sealing element 30 lies between 0° and at most 45° and such that, on inward travel, the angle β between the perpendicular S and the tangent T amounts in particular constructions to between 0° and 70° and otherwise to between 0° and at most 50°.

FIG. 2 likewise indicates the oval or elliptical cross-section 430 of the swivel arm 43. As a result of the flow-optimized, droplet-shaped or oval embodiment of the swivel arm 43, it is possible, in the case of high rigidity relative to the forces and torques applied by the pumping process, to provide a minimum flow resistance against the mass flow rate of the pumped medium in the outlet region. Since the swivel arm 43 and the overall sealing arrangement is arranged on the outlet side, the differential pressure between the outlet side and the inlet side may be used to increase the contact force between the sealing element 30 and the contour of the lobe 20.

The distance between the line of contact 24 and the swivel axis 41 of the swivel arm 43 varies depending on the angle of rotation and position of the sealing element 30 on the contour of the lobe 20. The maximum line of action radius $R_{Wmax}$ is achieved if the rounded contact portion 32 rests with its remotest point against the lobe surface, while the minimum line of action radius $R_{Wmin}$ is achieved if the end remote from the rounded contact portion 32 comes into contact with the lobe surface.

FIG. 3 is a schematic sectional representation of a lobe 20, which is mounted so as to be rotatable about the swivel axis 21. The lobe 20 has an inward travel side 221 and an outward travel side 222. The two-vaned lobe 20 has a contour which is point-symmetrical relative to the center point 21, which forms the point of rotation. The maximum lobe radius $R_{Pmax}$ results from the maximum distance from the axis of rotation 21 to the external contour of the lobe 20. To the right and left of the connecting line between the two maximum lobe radii $R_{Pmax}$, it is apparent that the contour of the conveying vane 22 on the outward travel side 222 is further from the connecting line than the contour of the conveying vane 22 on the inward travel side 221. There is thus more material in the region associated with the outward travel side 222. After reaching the maximum lobe radius $R_{Pmax}$ the sealing element 30 travels, on further rotation of the lobe 20, very rapidly towards a minimum lobe radius, whereas an outward travel movement on the outward travel side 222 takes place significantly more slowly.

FIG. 4 shows the geometric relationships and the contour of the lobe 20 in greater detail. The represented contour of the lobe 20 is point-symmetrical relative to the center point 21 of the minimum lobe radius $R_{Pmin}$. From the maximum lobe radius $R_{Pmax}$, the contour falls away steeply on the inward travel side 221 towards the minimum lobe radius $R_{Pmin}$. On the inward travel side, the contour curve has an inflection point in the curvature, roughly at the level of half the maximum lobe radius. The contour then runs on to the minimum lobe radius $R_{Pmin}$, follows this and then develops into the outward travel side 222, on which the contour experiences curvature without inflection point to the maximum lobe radius $R_{Pmax}$.

If the contour of the lobe is observed over the angle of rotation, the inward travel side 221 extends in this exemplary embodiment over an angle of rotation of around 40°, if the represented position is the starting position. Over an angular range of around 20° the contour follows the minimum lobe radius $R_{Pmin}$, in order then to form the outward travel side 222 for an angle of rotation range of around 120°.

Due to the non-mirror-symmetrical embodiment of the lobe contour relative to the connecting line of the two maximum lobe radii $R_{Pmax}$, different inward travel speeds and outward travel speeds are achieved at a constant rotational speed of the lobe 20. Due to the gentle gradient of the contour on the outward travel side, the sealing element 30 and thus also the sealing body 42 are urged outwards significantly more slowly than they can travel inwards. In addition to the improvements with regard to energy consumption, the embodiment of the lobe 20 with a steeper gradient on the inward travel side 221 compared with the gradient behavior on the outward travel side 220 leads to an enlarged pump chamber volume, since the material and volume of the lobe 20 are reduced on the inward travel side. The comparatively larger amount of material on the outward travel side ensures sufficient stability of the lobe 20. Thus, an enlargement of the pump volume may be achieved per revolution of the lobe 20 with constant stability and improved pump behavior.

FIG. 5 shows an individual representation of a sealing element 30 which can be arranged interchangeably on the sealing body 42. The sealing element 30 has a planar contact surface 31 and an adjacent rounded, distal contact portion 32, which is oriented away from the bearing point 41. The sealing element 30 likewise has a proximal rounded contact portion 33 oriented towards the bearing point 41, which may likewise come into contact with the contour of the lobe 20. As is apparent in FIGS. 1 and 2, the rounded contact portion 32 slides substantially over the contour of the lobe 20 during the inward travel movement, while, once the minimum lobe radius has been reached, the line of contact 24 or the point of contact 24 between the sealing element 30 and the lobe 20 runs over the planar contact surface 31 and advances towards the end 33 of the sealing element 30 of rounded configuration opposite the rounded contact portion 32. The line of contact 24 or the point of contact 24 thus advances along the sealing element 30 over the angle of rotation of the lobe. It has proven particularly advantageous for the small radius 33 to extend over an angle greater than 90°, before the adjoining surface 34 is reached. In this way, the surface 34 acts as a scraper for scraping the medium to be delivered off the lobe.

FIG. 6 shows the sequence of points of contact over a half-revolution of a lobe with two conveying vanes and thus clarifies the line of action between the extreme values $R_{Wmax}$ and $R_{Wmin}$. The line of action for outward travel on the outward travel side 222 provides first of all that the swivel arm 43 is moved outwards away from the axis of rotation 21 towards the maximum lobe radius. This is shown by the ascending right-hand portion of the diagram in FIG. 6. Once the maximum lobe radius is reached, the line of action advances to the left-hand region of the diagram, this being made clear by the arrow at the upper portion of the diagram extending obliquely leftward. Then the point of contact or the line of contact advances downwards over an enlarged line of action radius on the inward travel side 221, i.e. towards the axis of rotation 21. Once the minimum lobe radius is reached, the line of contact or the point of contact advances back to a smaller radius, which is shown by the lower right-hand half-region of the diagram.

FIG. 7 is a basic representation of how the point of contact 24 or the line of contact 24 between the sealing element 30 and the contour of the lobe 20 advances between a maximum line of action radius $R_{Wmax}$ and a minimum line of action radius $R_{Wmin}$. To ensure that there is no double contact between sealing element 30 and lobe 20, the sealing strip is inclined at an angle α of between 5° and 25°, in particular between 12° and 18° between the straight line through the point of rotation of the swivel arm 43 and the point of contact of the sealing element 30 and the planar contact surface 31 in the maximum lobe radius position.

With a lobe pump as described above, it is possible to move the sealing element over the smallest possible path from a maximum lobe radius to a minimum lobe radius, without the sealing element coming away from the lobe surface. The inward arching of the conveying vane on the inward travel side makes it possible to bring about on the one hand different lines of action on inward travel and outward travel of the sealing element and on the other hand a maximum inward travel speed of the sealing element and a reduced outward travel speed of the sealing element. Furthermore, the particular shaping reduces friction between the sealing element and the piston, in particular during the outward travel movement as a result of limitation of the angle between the perpendicular to the lobe and the tangent to the direction of movement of the sealing element.

A quasi-linear movement of the sealing element is achieved due to the comparatively large radius in the event of swivelable mounting of the sealing body on a swivel arm, this being 1.5 to two times as large as the radius of the lobe.

LIST OF REFERENCE NUMERALS

1—Lobe pump
10—Housing
11—Inlet
12—Outlet
20—Lobe
21—Axis of rotation of lobe
22—Conveying vane
221—Inward travel side
222—Outward travel side
24—Point of contact/line of contact
30—Sealing element
31—Contact surface
32—Contact portion
33—Contact portion
34—Scraping surface
35—Sealing strip
36—Top
37—Thread
38—Bottom
39—Step
40—Sealing body
41—Bearing point
42—Locking vane
43—Swivel arm
44—Cavity
45—Hole
430—Swivel arm cross-section
$B_D$—Width of sealing element
$R_{Pmin}$—Minimum lobe radius
$R_{Pmax}$—Maximum lobe radius
$R_{Wmin}$—Minimum line of action radius
$R_{Wmax}$—Maximum line of action
S—Perpendicular to the lobe surface
T—Tangent to the direction of movement of the sealing element
α—Angle between contact surface and connecting line bearing point of contact
β—Angle between S and T

The invention claimed is:

1. A lobe pump, comprising:

a housing having an inlet and an outlet for a medium to be pumped, at least one lobe mounted in the housing so as to be drivable and rotatable and which has at least two conveying vanes wherein each of said at least two conveying vanes is provided with a contour, wherein said at least one lobe conveys the medium to be delivered from the inlet to the outlet, at least one sealing element per lobe mounted on a sealing body, wherein the at least one sealing element runs over a contour of the at least one lobe during rotation of the at least one lobe and performs an outward travel movement from a minimum diameter of the at least one lobe to a maximum diameter of the at least one lobe and an inward travel movement from the maximum diameter of the at least one lobe to the minimum diameter of the at least one lobe on different sides of each of the at least two conveying vanes, wherein a distance which the at least one sealing element covers on an inward travel side of each conveying vane during the inward travel movement is smaller than a distance on an outward travel side which the at least one sealing element covers during the outward travel movement, and wherein a contour on an outward travel side has a curvature without an inflection point and a contour on an inward travel side has at least one inflection point.

2. The lobe pump as claimed in claim 1 wherein a minimum lobe radius on the inward travel side is reached by the at least one sealing element at an angle of rotation ranging from 20° to 90° from the maximum lobe radius.

3. The lobe pump as claimed in claim 1 wherein a maximum lobe radius is reached by the at least one sealing element, once it has left a minimum lobe radius and passes on the outward travel side at an angle of rotation ranging from 90° to 160°.

4. The lobe pump as claimed in claim 1 wherein a cross-sectional area of each conveying vane of the at least two conveying vanes is smaller on the inward travel side than on the outward travel side.

5. The lobe pump according to claim 1 wherein the at least two conveying vanes have two conveying vanes, wherein the contours of the two conveying vanes are point-symmetrical to an axis of rotation.

6. The lobe pump as claimed in claim 1 wherein the at least one sealing element is mounted swivelably within the housing on a locking vane or the at least one sealing element is embodied as a displaceable, spring-loaded slide.

7. The lobe pump as claimed in claim 6, wherein a distance between a bearing point of the locking vane and a point of contact of the at least one sealing element with the conveying vane ranges from is 1.5 times to 2 times as large as a lobe radius.

8. The lobe pump as claimed in claim 6, wherein the locking vane is mounted in the housing on an outlet side and has a swivel arm with a rounded or oval cross-section.

9. The lobe pump as claimed in claim 1 wherein the at least one sealing element has a planar contact surface and at least one adjacent rounded contact portion.

10. The lobe pump as claimed in claim 9, wherein the at least one rounded contact portion extends over a circular arc with a central angle of greater than or equal to 90° and is adjoined by a scraping surface.

11. The lobe pump as claimed in claim 9 wherein an angle between a straight line through a bearing point of a swivel arm and a point of contact of the at least one sealing element and a planar contact surface, is at the maximum lobe radius from 5° to 25°.

12. The lobe pump of claim 11 wherein the angle ranges from 10 to 20 degrees.

13. The lobe pump of claim 11 wherein the angle ranges from 12 to 18 degrees.

14. The lobe pump as claimed in claim 1 wherein at a point of contact of the at least one lobe and the at least one sealing element, an angle between a perpendicular to a lobe surface and a tangent to a path of movement of the at least one sealing element ranges from 0° to 70° on an inward travel movement and from 0° to 45° on an outward travel movement.

15. The lobe pump as claimed in claim 1 wherein a line of action of the at least one sealing element as a profile of a distance between a point of contact of the at least one sealing element and a bearing point thereof, is different on an outward travel side from the line of action of the at least one sealing element on an inward travel side.

16. The lobe pump as claimed in claim 15, wherein the line of action of the at least one sealing element on the outward travel side has a smaller radius than on the inward travel side.

* * * * *